US008945679B2

(12) United States Patent
Leitner et al.

(10) Patent No.: US 8,945,679 B2
(45) Date of Patent: Feb. 3, 2015

(54) APPARATUS FOR IMPREGNATING WEB-LIKE MATERIALS WITH THERMALLY CURABLE IMPREGNATING RESIN

(75) Inventors: Paul Leitner, Tiefgraben (AT); Alois Gruber, Buermoss (AT)

(73) Assignee: Kaindl Decor GmbH, Wals (AT)

( * ) Notice: Subject to any disclaimer, the term of this patent is extended or adjusted under 35 U.S.C. 154(b) by 862 days.

(21) Appl. No.: 13/122,891

(22) PCT Filed: Oct. 7, 2009

(86) PCT No.: PCT/EP2009/063040

§ 371 (c)(1), (2), (4) Date: Aug. 9, 2011

(87) PCT Pub. No.: WO2010/040781

PCT Pub. Date: Apr. 15, 2010

(65) Prior Publication Data

US 2011/0290180 A1 Dec. 1, 2011

(30) Foreign Application Priority Data

Oct. 7, 2008 (DE) ..... 10 2008 050 704

(51) Int. Cl.

| | |
|---|---|
| ***B05D 1/00*** | (2006.01) |
| ***D21H 17/20*** | (2006.01) |
| ***D06B 3/10*** | (2006.01) |
| ***D06C 7/00*** | (2006.01) |
| ***D21H 19/24*** | (2006.01) |
| ***D21H 21/16*** | (2006.01) |
| ***D21H 23/22*** | (2006.01) |

(Continued)

(52) U.S. Cl.

CPC ..... *D21H 17/20* (2013.01); *D06B 3/10* (2013.01); *D06C 7/00* (2013.01); *D21H 19/24* (2013.01); *D21H 21/16* (2013.01); *D21H 23/22* (2013.01); *D21H 25/02* (2013.01); *B05C 3/125* (2013.01)

USPC ..... 427/384; 427/385.5; 427/422; 427/424; 427/427.4; 427/430.1; 427/434.2

(58) Field of Classification Search

None

See application file for complete search history.

(56) References Cited

U.S. PATENT DOCUMENTS 2,343,601 A * 3/1944 Weimann ..... 156/549
2,489,456 A * 11/1949 Liebel ..... 427/435

(Continued)

FOREIGN PATENT DOCUMENTS

EP 0726 358 A2 8/1996
GB 2 146 673 4/1985

(Continued)

OTHER PUBLICATIONS

International Search Report that issued with respect to counterpart Application No. PCT/2009/063040 dated Jan. 18, 2011.

*Primary Examiner* — Erma Cameron

(74) *Attorney, Agent, or Firm* — Greenblum & Bernstein, P.L.C.

(57) ABSTRACT

An apparatus for impregnating web material with thermally curable impregnating resin, The apparatus includes an impregnating trough in which the web material is brought into contact with the impregnating resin and an inlet line which leads to the impregnating trough and through which the impregnating resin is introduced into the impregnating trough. The apparatus also includes a heating device structured and arranged for heating the impregnating resin, wherein the heating device is associated with the inlet line and heats the impregnating resin in the inlet line.

5 Claims, 1 Drawing Sheet

(51) Int. Cl.
*D21H 25/02* (2006.01)
*B05C 3/12* (2006.01)

(56) References Cited

U.S. PATENT DOCUMENTS 2,936,733 A * 5/1960 Duggins ..... 118/115
3,128,206 A * 4/1964 Dungler ..... 118/50
3,511,693 A * 5/1970 Davidson ..... 427/345
3,580,218 A * 5/1971 Grundschober et al. ..... 118/621
3,671,298 A * 6/1972 Maynard ..... 427/434.2
3,981,162 A * 9/1976 Klier ..... 68/5 E
4,051,278 A * 9/1977 Democh ..... 427/326
4,259,379 A * 3/1981 Britton et al. ..... 427/356
5,110,275 A * 5/1992 Scheuring ..... 425/113
5,483,873 A * 1/1996 Koivukunnas et al. ..... 100/38
6,174,369 B1 1/2001 Unger et al.
6,699,328 B1 * 3/2004 Scholzig et al. ..... 118/641
7,845,308 B1 * 12/2010 Corneille et al. ..... 118/667
2005/0074544 A1 * 4/2005 Pacetti et al. ..... 427/2.1
2011/0192048 A1 * 8/2011 Leitner et al. ..... 34/444

FOREIGN PATENT DOCUMENTS

WO WO 00/28137 A2 5/2000
WO WO 03/084681 * 10/2003

* cited by examiner 10
60
62
26
26a
64
52
24
44
46
16a
16
22
50
42
40
48
20
20a
38
18
14
54
36
34
28
12
58
32, 56, 60...
30
32
56

APPARATUS FOR IMPREGNATING WEB-LIKE MATERIALS WITH THERMALLY CURABLE IMPREGNATING RESIN

CROSS REFERENCE TO RELATED APPLICATIONS

The present application is a U.S. National Stage of International Application No. PCT/EP2009/063040 filed Oct. 7, 2009, which published as WO 2010/040781 A2 on Apr. 15, 2010, the disclosure of which is expressly incorporated by reference herein in its entirety. Further, this application claims priority under 35 U.S.C. §119 and §365 of German Application No. 10 2008 050 704.0 filed Oct. 7, 2008.

BACKGROUND OF THE INVENTION

1. Field of the Invention

The present invention relates to an apparatus for impregnating web-like material with thermally curable impregnating resin, comprising an impregnating trough in which the web-like material is brought into contact with the impregnating resin, an inlet line which leads to the impregnating trough and through which the impregnating resin is introduced into the impregnating trough, and a heating device which heats the impregnating resin.

2. Background Description

Apparatuses of this type are generally known in practice.

The impregnating of web-like material with thermally curable impregnating resin serves, together with the subsequent drying of the impregnated web-like material, for the production of impregnates, such as are used individually or in the form of a laminate formed from such impregnates; for example, for the coating of base members formed from wood material, for instance in the production of panels for cladding surfaces, for example, flooring.

As web material there comes into consideration not only in the state of the art but also in connection with the present invention, in particular, a composite formed from natural fibres and/or synthetic fibres, for example, a fabric, such as a woven fabric or a non-woven fabric, a mat, a textile, a roving, or the like.

Preferably, the web material is paper, the weight per unit area of which in the non-impregnated state can amount to between approximately 25 g/m$^2$ and approximately 300 g/m$^2$. As is well known, the paper layer of an impregnate which is intended to form a visual surface of the end product can be printed with a desired decoration.

In order to enable the impregnating resin to penetrate into the web material, the impregnating resin is mixed with a solvent, for example, water, the function of which is to lower the viscosity of the synthetic resin. If desired, further additives, for example, a curing agent, can be admixed with the resultant impregnating liquor. The already impregnated web material has to be dried before further processing, i.e. the solvent has to be removed from the impregnate so that of the impregnating liquor only the impregnating resin remains in the finished product.

If, in the context of the present invention, it is mentioned hereinafter that the web material is impregnated with impregnating resin or that impregnating resin penetrates into the web material, it is meant thereby that the web material is impregnated with impregnating liquor or that impregnating liquor penetrates into the web material, respectively. However, with regard to the end product, ultimately what matters is only that the impregnating resin has also penetrated the web material and remains therein during subsequent drying. Moreover, at this point it is to be noted that, although in the context of the present invention "the synthetic resin" or "the impregnating resin" is always referred to in the singular, this resin may also be a mixture of different synthetic resins.

As in any other industrially used process, also in the production of impregnates it must be endeavored to allow this process to proceed as rapidly and effectively as possible so as to keep as low as possible the cost component incurred thereby in the end product. For this purpose, it is of the utmost importance to enable the web-like material to be impregnated as rapidly and effectively as possible with the impregnating resin and subsequently dried. The time required for the impregnation, as is well known, becomes shorter as the viscosity of the impregnating liquor decreases. In order to achieve an as low as possible viscosity of the impregnating liquor, on the one hand, its solid content, i.e., resin content, can be lowered and, on the other hand, its temperature can be raised.

The solvent to be additionally added to reduce the viscosity in relation to a predetermined quantity of resin has to be removed again from the impregnated web-like material in the subsequent drying stage. This consumes energy and time, and thus, again contributes to an increase in the costs of the impregnate. Altogether, therefore, there is no cost advantage.

However, in practice, limits are also imposed on raising the temperature; in other words, the impregnating resin cures more rapidly at a higher temperature, i.e. polymerizes more rapidly. However, as the molecular weight of the resin increases, it penetrates to a lesser extent into the web-like material and the finished impregnate can subsequently be further processed to a lesser extent. For example, at a temperature of the impregnating trough of more than 35° C., the useful life of the liquor is reduced to such an extent that, in the event of an interruption in production, the impregnating liquor becomes unusable so quickly that it would be necessary to dispose of all the impregnating liquor present in the production plant, i.e., in particular in the impregnating trough. Of course, this cannot be tolerated.

Another problem which already arises in the state of the art at the trough temperatures of at maximum 35° C., is that because of high resin flow rates of up to 2,000 kg liquor/h the heat-exchanger surfaces of the impregnating trough have to be rather hot so as to enable the impregnating liquor accommodated in the impregnating trough to be brought to the desired trough temperature. Owing to the fact that, as a result of the geometrical configuration of the troughs, laminar flow regions naturally occur and in the most unfavorable cases even dead spaces are present, resin incrustations are formed time after time on the heat-exchanger surfaces, which in the course of time impair the heat transfer even further. A vicious circle is thereby instigated of ever-increasing necessary temperatures on the heat-exchanger surfaces and, accordingly, ever more rapidly occurring formation of incrustations—the trough "clogs up".

SUMMARY OF THE INVENTION

Therefore, it is an aim of the present invention to develop an apparatus of the type defined so that the impregnation of web-like material with thermally curable impregnating resin can be carried out more effectively.

According to the invention, this aim is achieved by an apparatus of the type indicated in the introduction, in which the heating device is associated with the inlet line and heats the impregnating resin in the inlet line. Therefore, according to the invention, the impregnating resin is no longer heated in the impregnating trough but in a heating device disposed upstream of the impregnating trough. The wall surfaces of the impregnating trough thereby no longer need to be used as heat-exchanger surfaces for heating the impregnating resin, so that the danger of incrustations being formed on these walls can at least be reduced, if not even entirely excluded.

Therefore, it is possible for the impregnating resin, more precisely the impregnating liquor, to be fed to the impregnating trough at a higher temperature, in particular a temperature of between approximately 50° C. and approximately 80° C., and therefore at a lower viscosity than was possible in the prior art. The penetration behavior of the impregnating resin into the web-like material can be improved thereby. Alternatively, however, the impregnating liquor can also contain less solvent and owing to the higher temperature have a viscosity which corresponds to that of an impregnating liquor of the prior art with a higher solvent content and a lower temperature. The subsequent drying can thereby proceed more effectively. Of course, these two effects can also be used combined with one another. In whatever form the advantageous consequences of the temperature increase made possible by the present invention are utilized, the impregnating process will in any case proceed more effectively as a result of using the impregnating apparatus according to the invention. In the first-mentioned case, the impregnating process itself proceeds more rapidly, whereby the amount of web-like material impregnated per unit of time is increased. And in the other case, the drying of the impregnated web-like material can be carried out more rapidly and using less energy.

In order to be able to prevent the formation of incrustations also in the heating device arranged upstream of the impregnating trough, in an embodiment of the invention, it is proposed that the heating device is a heating device operating contactlessly. For this purpose, the heating device can heat the impregnating resin using microwave radiation.

It may also be advantageous if a control device is provided, which ensures that only the amount of impregnating resin required for the impregnation is fed to the heating device. In particular, it is thereby possible for the amount of energy consumed to heat the impregnating resin to be reduced to a minimum. The control device can operate depending on the detection signal of at least one sensor which detects at least one operating parameter of the impregnating apparatus, for example depending on the machine speed, i.e., depending on the speed at which the web-like material is fed to the impregnating trough. The control device can also be connected to a pump, which feeds to the heating device the amount of impregnating resin required for the impregnation, or to other functional units of the impregnating apparatus.

In a further embodiment of the invention, it is proposed that the impregnating trough is provided with a cooling device. This cooling device can be used, for example in the event of an interruption in production, to cool the impregnating resin so as to reduce the polymerization rate and thereby increase the useful life of the liquor so that the resin can still be used even after production has been resumed.

This cooling device can comprise an integrated cooling unit. For example, therefore, the heat-exchanger device already present in impregnating troughs of the prior art can now be used not for heating but rather for cooling the impregnating liquor.

Additionally or alternatively, however, it is also possible for the cooling device to comprise an external cooling unit. This may be particularly advantageous if especially high cooling capacities are required. In this case, the impregnating liquor or the impregnating resin is pumped from the impregnating trough and through the external cooling unit so as to enable even more effective cooling to be achieved.

In an embodiment of the invention, it is further proposed that the impregnating trough is divided into at least two trough sections. This makes it possible to use a first trough section for the pre-impregnation and a second trough section for the main impregnation, wherein the impregnating resin can be kept preferably only in the first trough section at the raised temperature compared to the prior art, whereas in the second trough section it is kept at a temperature which corresponds, for example, to the temperature used in the prior art. This embodiment makes use of the fact that the actual penetration of the impregnating liquor into the web-like material takes place in the pre-impregnating stage and in the main impregnating stage it principally involves the correct dosing of the weight per unit area of the impregnating resin relative to the weight per unit area of the web-like material.

Therefore, it is also possible for a first trough section connected to the inlet line to have a smaller volume than a further trough section arranged further downstream in the flow direction of the resin. It is also advantageous if a further cooling unit is arranged between the two trough sections. If desired, the further cooling unit can be associated with a third trough section serving as a transition trough section, it being possible for this transition trough section to be attributed, for example, to the pre-impregnating stage.

Advantageously, the accommodating volumes of the plurality of trough sections can be formed separately from one another, i.e., in such a way that, on the one hand, a passage of impregnating liquor from an upstream trough section to a downstream trough section can take place; on the other hand, however, a transition of impregnating liquor from a downstream trough section to an upstream trough section is not possible.

In an embodiment of the invention, finally, it is also possible to provide a spraying device which moistens the web-like material, for example with water, preferably hot water or water vapor. As a result of this measure, the penetration of the impregnating liquor into the web-like material can be further improved. In this case, it is especially advantageous if the web-like material is both premoistened and preheated.

The use of the impregnating apparatus according to the invention makes possible impregnation with a distinctly high solids content of the impregnating liquor, whereby considerable amounts of energy can be saved during the subsequent drying or existing drying capacities make possible higher production rates. For example, it is possible to operate with a solids content of approximately 60% impregnating resin in the impregnating liquor.

Furthermore, it has surprisingly been found that the rheology of the impregnating liquor varies advantageously at relatively high temperatures. Thus, in conventional impregnating apparatus, contamination and damage constantly occurred as a result of the splashing of the resin in the impregnating zone. According to the invention, it has surprisingly now been found that at relatively high temperatures the splash tendency of the impregnating liquor decreases, thereby making possible longer maintenance intervals of the impregnating apparatus.

It should also be added that aminoplastic and phenoplastic resins can be used as impregnating resins. For example, the following resins can be considered as impregnating resins: urea formaldehyde resin, melamine formaldehyde resin, melamine urea formaldehyde resin (MUF), melamine urea phenol formaldehyde resin (MUPF), phenol formaldehyde resin (PF), tannin resins, resorcinol formaldehyde resins, silicone resins.

BRIEF DESCRIPTION OF THE DRAWINGS

One example of an embodiment of the invention will be described in more detail below with reference to the accompanying drawings, wherein.

DETAILED DESCRIPTION OF THE INVENTION

Figure 1:
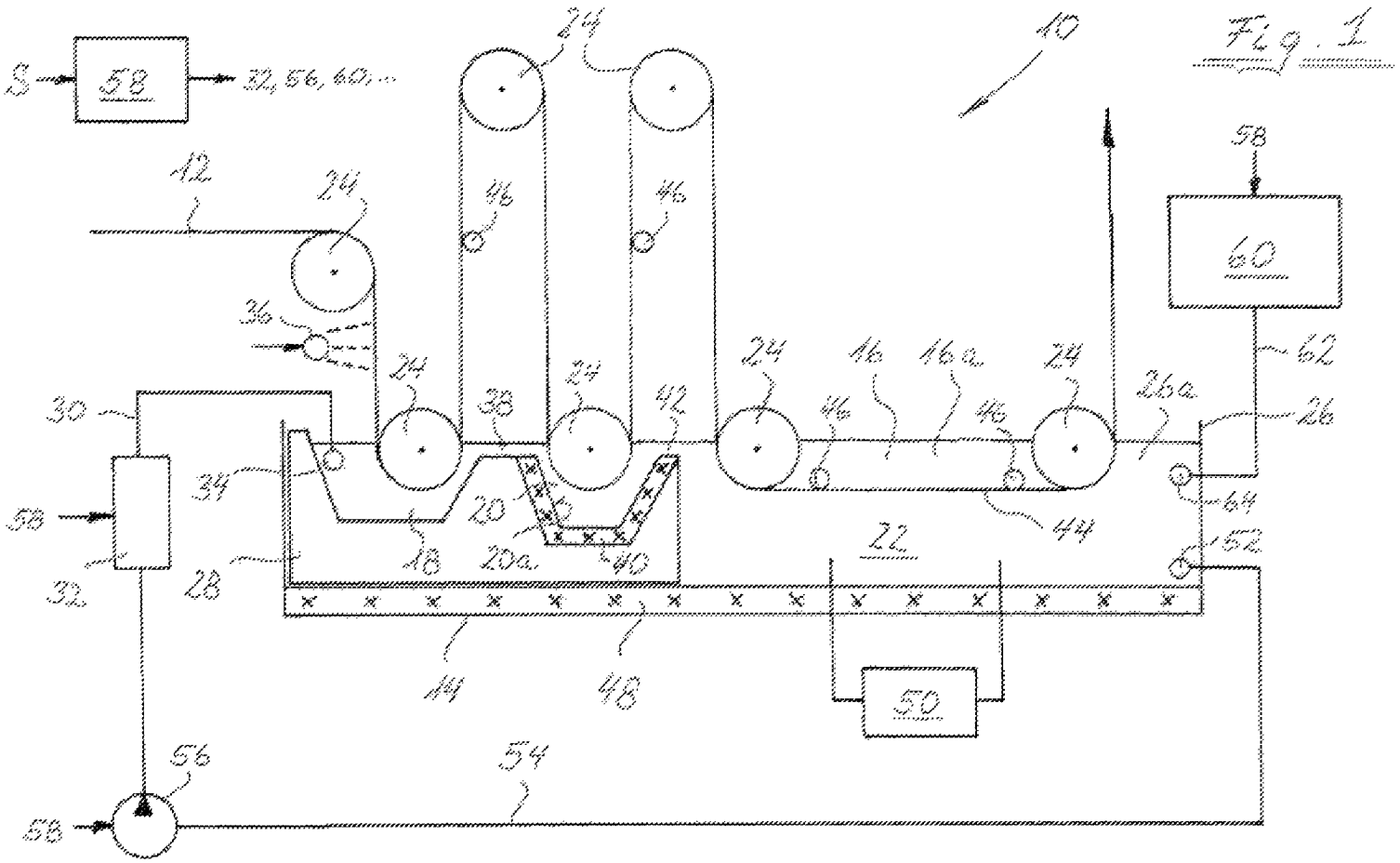
FIG. 1 shows a schematic illustration of the construction of an impregnating apparatus according to the invention.

In FIG. 1 an apparatus for impregnating a web-like material 12, for example a paper web, is denoted generally by the reference numeral 10. The impregnating apparatus 10 comprises an impregnating trough 14 in which the paper web 12 is impregnated with impregnating resin 16, more precisely impregnating liquor 16*a*.

In the example of embodiment illustrated, the impregnating trough 14 is divided into three trough sections 18, 20 and 22, through which the material web 12 passes successively along a web path predetermined by guide rollers 24. In respect of its construction and arrangement and also in respect of the question whether one or more of these guide rollers are driven, the guide rollers 24 correspond to those of an impregnating apparatus of the state of art. Therefore, a detailed description thereof will be dispensed with here.

In the example of embodiment illustrated, the impregnating apparatus 10 comprises a trough body 26 with a trough volume 26*a*. An insert body 28 is inserted into the trough body 26, in which the first trough section 18 and the second trough section 20 are formed. The partial volume of the trough volume 26*a* not occupied by the insert body 28 forms the third trough section 22. According to the invention, the volume of the first trough section 18 is smaller than the volume of the second trough section 20 and the latter is, in turn, smaller than the volume of the third trough section 22.

During the operation of the impregnating apparatus 10, impregnating liquor 16*a* is fed to the first trough section 18 via an inlet line 30, the impregnating liquor having been previously heated contactlessly in a heating device 32, preferably by microwave radiation. The inflow of the inlet line 30 into the first trough section 18 is shown at 34. According to the invention, the impregnating liquor 16*a* can comprise approximately 60% solids content of impregnating resin 16, for example melamine resin, in a solvent, for example water, and can be introduced into the first trough section 18 at a temperature of approximately 50° C. to 80° C. Owing to this high temperature, the impregnating liquor 16*a* exhibits such a low viscosity, despite its high solids content, that in first trough section 18 it can penetrate readily into the material web 12 so as to saturate it. To facilitate the penetration, the material web 12 can, before entering the first trough section 18, be moistened by a spraying device 36 and, if desired, also preheated.

From the first trough section 18 the impregnating liquor enters the second trough section 20 via an overflow 38. The boundary walls 20*a* of the second trough section 20 are in the form of heat-exchanger surfaces of a cooling unit 40 which cools the impregnating liquor 16*a* to a temperature of approximately 30° C. so as to increase considerably its useful life. In addition, the material web 12 is again impregnated with impregnating liquor 16*a* in the second trough section 20.

From the second trough section 20 the impregnating liquor 16*a* enters via an overflow 42 into the third trough section 22, in which an immersion path 44 for the material web 12 is provided. Whereas the actual saturation of the material web 12 with impregnating liquor 16*a* takes place in the first two trough sections 18 and 20, the main function of the immersion path 44 in the third trough section 22 is to ensure that the material web 12 is loaded with the desired amount of impregnating liquor 16*a*.

Although doctor rods 46 are provided at different locations in FIG. 1, the purpose of which is to remove excess impregnating liquor 16*a* from the surface of the material web 12 and/or uniformly distribute and/or smooth the impregnating liquor 16*a* applied to the material web 12, the present invention is not concerned with this partial aspect. Therefore, a detailed description will also be dispensed with in this respect.

As indicated schematically in FIG. 1, a cooling device 48 is provided in the bottom of the impregnating trough 26, the purpose of which is, on the one hand, to keep the impregnating liquor 16*a* in the third trough section 22 at the desired temperature of approximately 30° C., but which in the event of a production shut down, on the other hand, is also used to cool the impregnating liquor 16*a* further so as to increase its useful life to such an extent that, after a resumption in production, it can still be used without loss. If necessary, it is also possible to provide for this purpose an external cooling device 50 which recirculates and cools the impregnating liquor 16*a* from the trough volume 26*a*.

Even in normal production operation, the impregnating liquor 16*a* is recirculated. In fact, it is removed from the trough volume 26*a* via an outlet 52 and conveyed via a line 54 by a pump 56 to the microwave heating device 32 and via the inlet line 30 on to the inlet 34 into the first trough section 18. In this case, the pump 56 and the microwave heating device 32 preferably operate under the control of a control unit 58 so that, on the one hand, it is ensured that the exact amount of impregnating liquor 16*a* is always introduced into the first trough section 18, which is required depending on the production rate, in particular the running speed of the material web 12, and that the impregnating liquor 16*a* is introduced into the first trough section 18 at the desired temperature.

In addition, a dosing device 60 ensures that the exact amount of impregnating liquor 16*a* is always resupplied into the trough volume 26*a* via a line 62 and an inlet 64, which the material web 12 removes from the impregnating device 10 as a result of the impregnation. In this way, it can be ensured that the level of the impregnating liquor 16 in the trough sections 18, 20 and 22 can always be kept at the same height. The dosing device 60 preferably also operates under the control of the control device 58.

Furthermore, the detection signals of a plurality of sensors S can be fed to the control device 58, for example, a sensor for detecting the speed of the material web 12, a sensor for detecting the temperature of the impregnating liquor 16*a* introduced into the first trough section 18, a sensor for detecting the level of the impregnating liquor 16*a* in the trough sections 18, 20 and 22, and other such sensors. These sensors and their connecting leads to the control device 58 are not illustrated in FIG. 1 for reasons of clarity of illustration.

It should also be added that the embodiment illustrated in FIG. 1 is suitable for retrofitting to existing impregnating apparatus of the state of the art. In addition to the provision of a microwave heating device 32, it is in fact only necessary for the insert body 28, in which the first two trough sections 18 and 20 are formed, to be inserted into the trough volume 26*a* of the impregnating trough 26 so as to make from an impregnating apparatus of the state of the art an impregnating apparatus 10 according to the invention. In principle, however, it is also possible to provide an impregnating trough specially designed for this purpose.

The invention claimed is:

1. A method of impregnating web material with thermally curable impregnating resin in an impregnating trough in which the web material is brought into contact with the impregnating resin, comprising:

heating the impregnating resin in an inlet line which leads to the impregnating trough and through which the impregnating resin is introduced into the impregnating trough;

supplying the impregnating resin to the impregnating trough; and passing the web material into the impregnating trough, wherein the impregnating resin is impregnated into the web material, wherein the impregnating trough is divided into at least two trough sections, wherein:

the at least two trough sections comprise a first trough section connected to the inlet line and at least one further trough section arranged further downstream in a flow direction of the impregnating resin, and the first trough section comprises a smaller volume than a volume of the at least one further trough section.

2. The method of claim 1, wherein the heating the impregnating resin comprises heating the impregnating resin using a contactless heating device.

3. The method of claim 1, wherein the heating the impregnating resin comprises heating the impregnating resin using microwave radiation.

4. The method of claim 1, further comprising cooling the impregnating trough with at least one of an integrated cooling unit and an external cooling unit.

5. The method of claim 1, further comprising supplying a substance via a spraying device to moisten the web material upstream of the impregnating trough.

* * * * *